United States Patent [19]

Engelfriet et al.

[11] 4,392,397

[45] Jul. 12, 1983

[54] METHOD OF PRODUCING A DRAWING DIE

[75] Inventors: Adrianus R. C. Engelfriet; Adriaan J. G. Op Het Veld; Theodorus J. P. Van Vucht, all of Eindhoven, Netherlands

[73] Assignee: U.S. Philips Corporation, New York, N.Y.

[21] Appl. No.: 161,197

[22] Filed: Jun. 19, 1980

[30] Foreign Application Priority Data

Jun. 25, 1979 [NL] Netherlands ..... 7904922

[51] Int. Cl.[3] ..... B23P 15/24; B21C 3/02

[52] U.S. Cl. ..... 76/107 A

[58] Field of Search ..... 76/107 A, 107 R

[56] References Cited

U.S. PATENT DOCUMENTS

| | | | |
|---|---|---|---|
| 1,904,698 | 4/1933 | Simons | 76/107 A |
| 2,256,912 | 9/1941 | Welch | 76/107 A |
| 2,364,005 | 11/1944 | Simons | 76/107 A |
| 2,866,364 | 12/1958 | Bieberich | 76/107 A |
| 3,831,428 | 8/1974 | Wentorf, Jr. | 76/107 A |
| 4,129,052 | 12/1978 | Bieberich | 76/107 A |
| 4,144,739 | 3/1979 | Corbin | 72/467 |

FOREIGN PATENT DOCUMENTS

| | | | |
|---|---|---|---|
| 320990 | 5/1920 | Fed. Rep. of Germany | 76/107 A |
| 522795 | 6/1940 | United Kingdom | 76/107 A |
| 1466321 | 3/1977 | United Kingdom . | |

*Primary Examiner*—Roscoe V. Parker

*Attorney, Agent, or Firm*—Marc D. Schechter

[57] ABSTRACT

The disclosure relates to the manufacture of wire-drawing dies. The disclosure provides a method for securing a core in a metal housing. The method begins with the clamping of an annulus, consisting of a hardenable metal alloy, around a cylindrical core consisting of a material such as polycrystalline diamond or boron nitride. The core is clamped so as to produce a permanent, radially compressive stress therein. The core-annulus combination is secured in a metal housing of a conventional shape.

4 Claims, 8 Drawing Figures

METHOD OF PRODUCING A DRAWING DIE

BACKGROUND OF THE INVENTION

The invention relates to a method of producing a wire-drawing die. In the method, a core is mounted in an annulus which is then secured in a metal housing. The core is then provided with a drawing passage. The core may consist of a material such as polycrystalline diamond, polycrystalline cubic boron nitride or a mixture thereof.

In this connection, "polycrystalline diamond" should be understood to mean an aggregate of synthetic diamond. Polycrystalline diamond is commercially available under various designations (e.g. "Compax"—General Electric Company, USA, and "Syndite"—De Beers Industrial Diamond Division). On delivery, the aggregate of synthetic diamond is usually attached to a cemented carbide substrate (for example WC+Co). The substrate may be flat or annular. In the latter case, the aggregate of synthetic diamond fills the opening in the annular substrate.

The annular substrate filled with synthetic diamond is usually used for the production of wire-drawing dies. However, the heat conductivity of cemented carbides is relatively low, which is a drawback for this use. It is also necessary to use special tools to produce each individual size of the synthetic diamond/cemented carbide annular combination. Sometimes the cemented carbide annulus must be treated, for example by means of shrinking or pressing, in order to secure it in a metal housing.

Polycrystalline cubic boron nitride is also commercially available (e.g. as "Amborite"—De Beers Industrial Diamond Division, and "Barozon CBN"—General Electric Company USA).

Wire-drawing dies having an aggregate of synthetic diamond mounted in a cemented carbide annulus are commercially available. Usually the core, which is mounted in a cemented carbide annulus, is fitted in a metal housing by means of a shrinking or pressing operation. For one type of wire-drawing die, the polycrystalline diamond core with a cemented carbide annulus is provided with an envelope of brass (e.g. 37.8% by weight of Zn, 3.4% by weight of Pb, remainder Cu) in such a way that the raised edges of the envelope are just clear from the drawing passage after the latter has been formed. The core mounted in the annulus is fitted by cold pressing in a metal housing consisting of austenitic chromium-nickel steel. A plug of austenitic chromium-nickel steel is also pressed into the housing.

SUMMARY OF THE INVENTION

It is an object of the invention to provide a method of producing a wire-drawing die by starting with a core of a hard, wear resistant material which is not mounted in a cemented carbide annulus. The core is subjected to a permanent compressive stress so as to reduce the likelihood that the core will tear when subjected to tensile stresses such as may occur during the drawing of metal wire. This is accomplished by means of a method in which the core is clamped in an annulus of a metal alloy which can be strengthened by means of a deformation and/or heat treatment. The annulus is strengthened during clamping, and then the core-annulus combination is fitted in a metal housing. A cylindrical core is preferably used in this method because such a shape uniformly distributes stress in the core as much as possible, and uniformly dissipates heat. The metal housing may have the customary cylindrical shape. The core can be fixed in the metal housing in a conventional manner using, for example, a retaining plug.

Strengthening of the annulus is desirable in order to increase its elastic limit $\tau_{0.2}$. As a result, the annulus exerts a permanent, radially compressive stress on the core. This compression reduces the tensile stress produced in the core during drawing and, consequently, it also reduces the susceptibility of the core material to tearing.

Preferably, the annulus consists of a metal alloy whose strength, when heated to a temperature of some hundreds of degrees Celsius above the ambient temperature (such as may occur in certain circumstances during the use of the wire-drawing die), either remains constant or increases. An increase in strength may be produced, for example, by means of a coherent or incoherent dispersion hardening.

The method according to the invention preferably uses alloys which have good heat conductivity, so that the heat generated during drawing or supplied by the hot wire can be dissipated. This assures that the core is not heated to an unacceptably high temperature and/or is not overloaded by temperature stresses.

In practice temperatures as high as, for example, 450° C. and 600° C., may be produced in the wire-drawing die during the drawing of wires of tungsten and steel, respectively.

The method according to the invention can proceed as follows. A cylinder consisting of a metal alloy which can be strengthened is provided. The cylinder has an axial bore with a diameter which is larger than the diameter of the core. The cylinder is placed in the central opening of a metal housing of a suitable shape. A core is then placed in the bore of the cylinder. The dimensions of the cylinder, the core and the metal housing can be chosen so that the cylinder can be deformed to a sufficient extent to clamp the core. This can be achieved with either a preheated or an unheated cylinder. When an unheated cylinder is used, the elastic limit and the associated hardness are increased by means of a cold deformation. When a preheated cylinder is used, it must be strengthened by, for example, precipitation hardening.

Alloys which are suitable for use in the method according to the invention are, for example, brass (copper-zinc alloys). At elevated temperatures, however, these alloys lose the strength obtained from cold deformation rather rapidly.

Other alloys which are suitable for use are, for example, hardenable aluminium alloys. An aluminium zinc alloy having the composition 5.5% by weight of Zn, 0.15% by weight of Mn, 2.5% by weight of Mg, 1.6% by weight of Cu, 0.25% by weight of Cr, with the remainder Al is one such alloy. An aluminium silicon alloy consisting of 1.0% by weight of Si, 0.7% by weight of Mn, 0.9% by weight of Mg, 0.15% by weight of Cr, with the remainder Al is another such alloy. Hardenable iron alloys consisting, for example, of 2.0–3.25% by weight of Ni, 1.00–1.80% by weight of Cr, 0.15–0.35% by weight of Si, 0.40–0.10% by weight of Mn, 0.18% by weight of C, 0.60% by weight of Mo, with the remainder Fe, and, for example, of 12.75% by weight of Cr, 8% by weight of Ni, 2.25% by weight of Mo, 1.15% by weight of Al, with the remainder Fe are also suitable.

In some cases it is advisable to use hardenable copper alloys having good heat conductivity, such as copper-chromium alloys (0.3–1.2% by weight of Cr, 0–0.2% by weight of Zr, with the remainder Cu), copper-beryllium alloys (1.9% by weight of Be, 0–0.6% by weight of (Co+Ni) with the remainder Cu, and 0.4–0.7% by weight of Be, 2–2.8% by weight of Co, 0–0.5% by weight of Ni, with the remainder Cu), copper-nickel silicon alloys (0.6–2.5% by weight of Ni, 0.5–0.8% by weight of Si, with the remainder Cu), and copper-cadmium alloys (0.7–1.3% by weight of Cd, with the remainder Cu, and 0.5–1.0% by weight of Cd, 0.2–0.6% by weight of Sn, with the remainder Cu). These copper-cadmium alloys can be strengthened by cold deformation; when heated, their strength will not increase, but they also will not lose the strength obtained by deformation.

With an alloy consisting of 0.6%–1.0% by weight of Cr, 0.1% by weight of Zr, and the remainder Cu, which proved in practice to be vary satisfactory in the method according to the invention, the elastic limit $\tau_{0.2}$ increases from 27 kg/mm$^2$ to 40 kg/mm$^2$ after a deformation of 20%. After prolonged heating, for example for 20 hours at approximately 400° C., a $\tau_{0.2}$ of 50 kg/mm$^2$ can be obtained, which indicates the occurrence of a coherent dispersion hardening.

Another alloy which is greatly strengthened on deformation is brass consisting of 37% by weight of Zn, with the remainder Cu. After a deformation of 20%, the $\tau_{0.2}$ was found to have increased from 15 kg/mm$^2$ to 65 kg/mm$^2$. However, it appears that on prolonged heating at 400° C., the $\tau_{0.2}$ decreases again to the initial value of 15 kg/mm$^2$. Therefore this alloy is not so suitable for use in wire-drawing dies for the drawing of those metals which release great amounts of heat during drawing and which have a poor heat conductivity, or which are drawn at elevated temperatures, such as tungsten, molybdenum and some steels.

In a further embodiment of the method according to the invention, the core is first pressed into a heated annulus and the annulus is heated until the desired strengthening has been obtained. Thereafter, the annulus containing the core is pressed into the metal housing using a cold deformation process. Finally, the annulus is enclosed in the housing by means of one or more retaining plugs.

It is alternatively possible to first place the core in the metal housing, and then press a preheated cylinder with an axial bore into the housing. The above-mentioned alloys, except for the copper-zinc and the copper-cadmium alloys, can be used for this purpose.

Preferably, the metal housing consists of a rust-resistant, workable alloy such as a ferritic chromium steel (for example AISI 430) or an austenitic chromium-nickel steel (for example AISI 302 or 304). The drawing passage in the core can be formed in a manner which is customary in this technology. For example, the drawing passage can be formed by means of laser drilling or spark erosion, either before or after the annulus holding the core has been secured in the metal housing.

BREIF DESCRIPTION OF THE DRAWING

The method according to the invention will now be further explained with reference to the accompanying drawing.

DESCRIPTION OF THE PREFERRED EMBODIMENTS

Embodiment I

Figure 1:
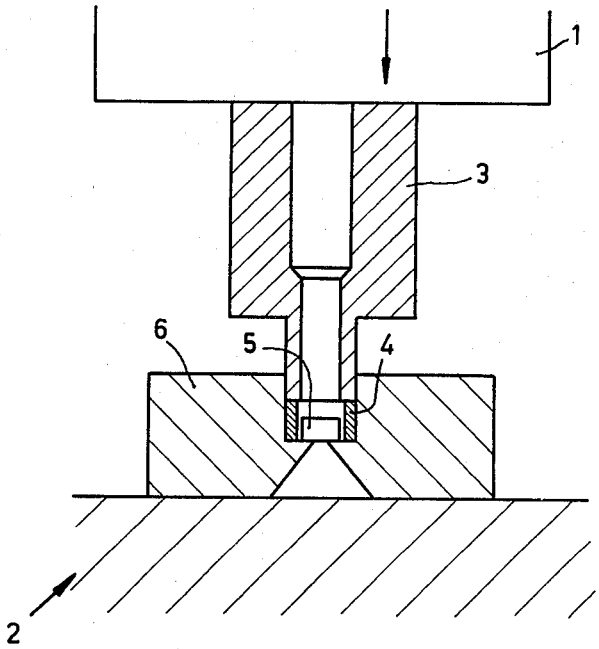
FIG. 1 is a cross-sectional view of a portion of a pressing device in which a metal housing with a core and a loose cylinder have been positioned.
Figure 2:
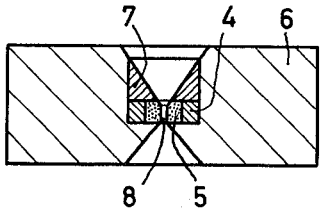
FIG. 2 is a cross-sectional view of a wire-drawing die obtained by means of the method shown in FIG. 1.

Referring to FIGS. 1 and 2, it will be explained how a wire-drawing die can be produced by means of a cold pressing operation. A cylinder 4, having a 3.6 mm diameter axial bore, is pressed into a cavity of a metal housing 6 so that it encircles a polycrystalline diamond core 5 having a diameter of 3.0 mm which was previously placed in the cavity. Metal housing 6 consists of ferritic chromium steel (AISI 430). Cylinder 4 is pressed into housing 6 by means of a simple hydraulic press, a portion of whose pressing blocks 1 and 2 are shown in FIG. 1, and a die 3. The dimensions of the cylinder 4 (which consist of 0.6% by weight of Cr, 0.1% by weight Zr, with the remainder Cu) were chosen so that the cylinder 4 was deformed 20% before it clamped the core 5. The total force applied was 2000 kgf. Thereafter, a retaining plug 7, also consisting of ferritic chromium steel (AISI 430), was pressed into the opening of the metal housing 6, and a draw passage 8 was made in the core 5 by laser drilling (FIG. 2).

Wire drawing experiments were performed with wire-drawing dies obtained by the method described above. For example, tungsten wire having a starting diameter of 650 μm was drawn through a die having a draw passage 8 with a diameter of 490 μm. In addition, copper wire having a starting diameter of 1000 μm was drawn through a die having a draw passage with a diameter of 900 μm, and copper wire having a diameter of 1100 μm was drawn through a die having a draw passage with a diameter of 1000 μm. In each case, the service lives of the dies were at least equal to, but were in most cases considerably longer than the lives of dies made of synthetic diamonds fitted in cemented carbide rings.

Embodiment II

In a manner similar to that described in Embodiment I, a wire-drawing die was produced from the same materials. However, the cylinder 4 was preheated to a temperature of 625° C. The cylinder 4 was not strengthened by cold deformation. Instead it was strengthened by means of a coherent precipitation hardening operation. This was achieved by heating the cylinder with the core after deformation of the cylinder, for a further 5 minutes at 625° C. The properties of the wire-drawing dies obtained in this manner do not materially differ from those of the dies described in Embodiment I.

Embodiment III

Figure 3:
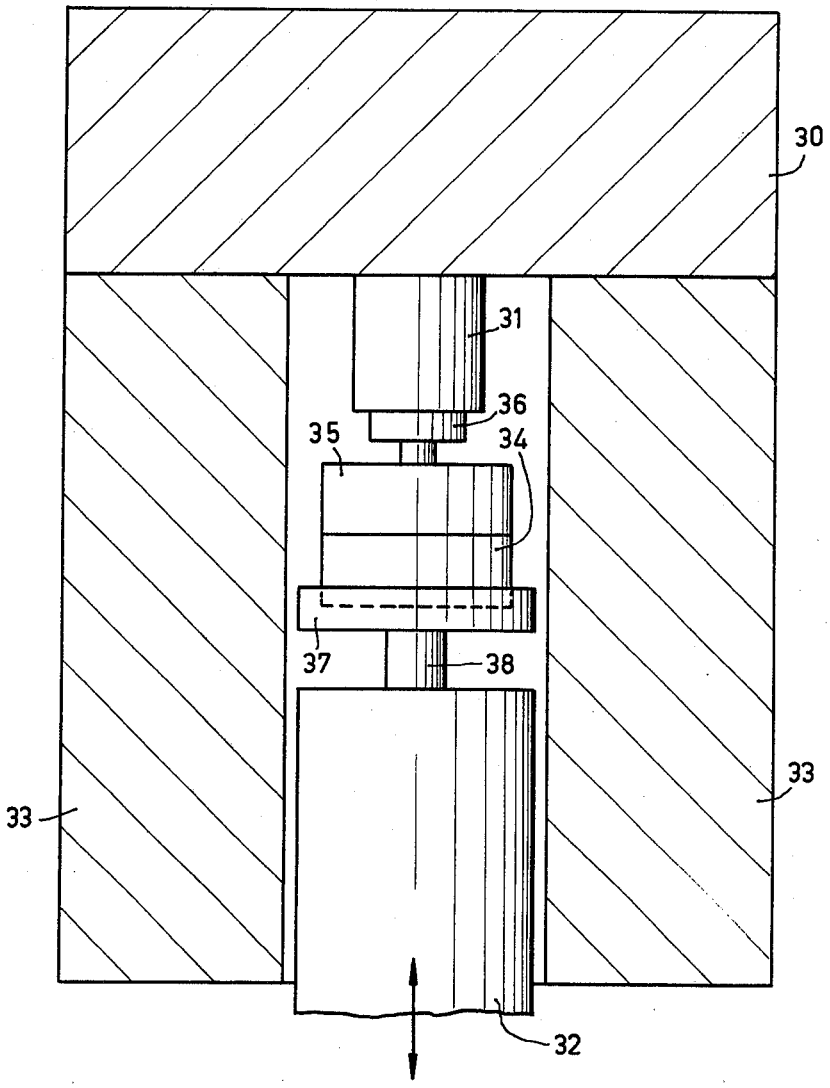
FIG. 3 is a view, partly in cross-section, of a portion of a pressing device for hot-pressing a core in an annulus.
Figure 4:
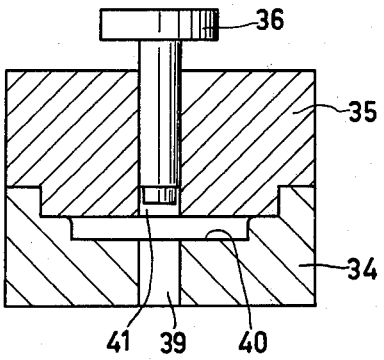
FIG. 4 is a cross-sectional view of a pressing die.

Referring to FIGS. 3 and 4, a device is shown for producing a wire-drawing die by pressing a synthetic diamond core into an opening of a heated annulus. With this device, the annulus is not materially deformed, as is the case in Embodiments I and II.

The device comprises a hydraulic press having a pressing block 30. The press is provided with a fixed upper die 31, a movable lower die 32, and a tubular oven 33. Between the upper and lower dies is a divided mold 34/35 having a movable molding die 36. The mold 34/35 is positioned on a dish 37 which is supported on lower die 32 by a rod 38. This construction was chosen in order to reduce the heat dissipation from the mold 34/35 to the lower die 32.

FIG. 4 shows the mold 34/35 in cross-section. The lower mold part 34 has a central opening 39, one end of which forms a support 40 for an annulus 43. (See FIG. 5). The upper mold part 35 has a central opening 41 in which the molding die 36 can be moved up and down.

A core made of synthetic diamond is mounted in an annulus in the following manner. While the movable lower die 32, the rod 38, and the dish 37 are outside the oven 33, the lower mold part 34 is placed on the dish 37. Thereafter, an annulus 43 (consisting of, for example 0.6% by weight of Cr, 0.1% by weight Zr, with the remainder Cu) is positioned on the surface 40 in the lower mold part 34.

Figure 5:
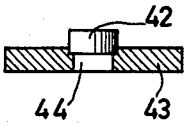
FIG. 5 is a cross-sectional view of an annulus with a core prior to pressing.

Annulus 43 is shown in FIG. 5, but it is not shown positioned on surface 40. An opening 44 is provided in annulus 43. One end of the opening 44 has been widened somewhat. A core 42 made of synthetic diamond is placed on the annulus 43 at the widened end of opening 44. The diameter of the synthetic diamond core 42 is, for example, 3.00 mm, the diameter of the opening 44 is, for example, 2.65 mm, and the diameter of the widened portion of opening 44 is for example, 3.03 mm. The upper mold part 35 is now placed on the lower mold part 34 and the molding die 36 is introduced into the opening 41. The lower die 32 is moved upward so that the molding die 36 contacts the upper die 31. The die 34/35 is now heated by means of the oven 33 to a temperature of 625° C. (The temperature of the mold 34/35 is measured by means of a thermo-couple, not shown.) Thereafter, the lower die 32 is raised further until the synthetic diamond core 42 has been pressed into the opening 44 in annulus 43; this is effected substantially pressure-free at the above-mentioned temperature.

During heating and pressing of the synthetic diamond core 42 into the annulus 43, the atmosphere in the volume enclosed by the oven 33 was weakly reducing. For this purpose, a mixture of nitrogen (79%) and hydrogen (21%) was passed into the oven. After pressing, the annulus 43 with the core 42 was cooled to ambient temperature in the same atmosphere.

Figure 6:
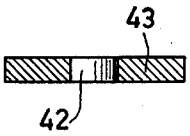
FIG. 6 is a cross-sectional view of an annulus with a pressed-in core.
Figure 7:
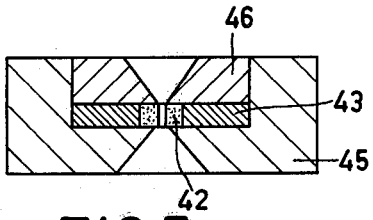
FIG. 7 is a cross-sectional view of a finished wire-drawing die.

FIG. 6 shows the annulus 43 with the pressed-in core 42. This combination was then after-treated so that the axis of the assembly coincides as close as possible with the axis of the core 42. Thereafter, the combination 42/43 was cold-pressed into the opening of a metal housing 45 (see FIG. 7) consisting of ferritic chromium steel (AISI 430). Finally, a retaining plug 46, consisting of ferritic chromium steel (AISI 430) was pressed into the opening of the housing, and the core 42 was provided with a drawing passage by laser drilling.

Embodiment IV

Figure 8:
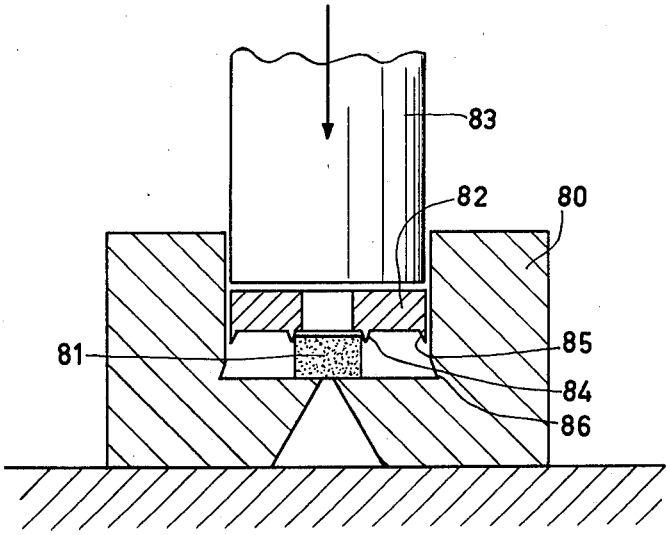
FIG. 8 is a cross-sectional view of a metal housing, including a ring and a core, prior to pressing.

Referring to FIG. 8, a core 81 was inserted in an opening in a metal housing 80. The core 81 was, for example, polycrystalline diamond. Next a hardenable metal annulus 82 was placed on top of the core. The metal housing 80 with core 81 and annulus 82 was then placed in a press.

The diameter of the aperture in the annulus 82 was less than the diameter of the core 81. The annulus 82 was pressed, while being deformed, around the core 82 in the metal housing 80 by means of a press (not shown) which had a cylindrical die 83. The combination of the metal housing 80, the core 81 and the annulus 82 was preferably at a temperature between 400 ° and 700° C., for example 550° C.

In this embodiment of the method, the annulus 82 may be provided with two ring-shaped edges 84 and 85 at the side facing the core. Edge 84 centers the core when the annulus 82 is brought into position. Edge 85 is pressed into a recess 86 in the metal housing 80, in order to ensure a secure mechanical connection between the annulus 82 and the metal housing 80. The materials mentioned in the preceding embodiments may be used in this embodiment.

It is, of course, possible to first place the annulus 82 in the metal housing and then press the core into the annulus.

In practice, the dies obtained by means of the method according to the invention have prove to be suitable for drawing tungsten and molybdenum wire, copper wire, stainless steel wire and so-called tire cord (steel wire coated with a brass layer).

What is claimed is:

1. A method of producing a wire-drawing die comprising the steps of:

providing a metal annulus having a bore; and clamping a core directly in the bore of the annulus, said core consisting of a hard, wear-resistant material; characterized in that:

the annulus consists of a metal alloy which can be strengthened by a heat treatment; and the method further comprises the step of increasing the ulitmate strength of the annulus by a heat treatment, while clamping the core therein.

2. A method of producing a wire-drawing die as claimed in claim 1, characterized in that the core consists of polycrystalline diamond, polycrystalline cubic boron nitride, or mixtures thereof.

3. A method of producing a wire-drawing die as claimed in claim 2, characterized in that the annulus consists of a precipitation hardenable copper alloy.

4. A method of producing a wire-drawing die as claimed in claim 3, characterized in that the method further comprises the steps of:

securing the annulus in a metal housing; and cutting a drawing passage through the core.

* * * * *

UNITED STATES PATENT AND TRADEMARK OFFICE

CERTIFICATE OF CORRECTION

PATENT NO. : 4,392,397

DATED : July 12, 1983

INVENTOR(S) : ADRIANUS R.C. ENGELFRIET ET AL

It is certified that error appears in the above-identified patent and that said Letters Patent is hereby corrected as shown below:

Claim 1, line 10 (column 6, line 48), change "ulitmate" to --ultimate--.

Signed and Sealed this

*Thirty-first* Day of *July 1984*

[SEAL]

*Attest:*

GERALD J. MOSSINGHOFF

*Attesting Officer*

*Commissioner of Patents and Trademarks*